United States Patent [19]

Romanowski et al.

[11] 3,984,717

[45] Oct. 5, 1976

[54] SPARK PLUG

[75] Inventors: Edward A. Romanowski; Dominic J. Bologna, both of Troy, Mich.

[73] Assignee: Chrysler Corporation, Highland Park, Mich.

[22] Filed: Aug. 30, 1973

[21] Appl. No.: 392,891

[52] U.S. Cl. ..... 313/141; 313/142

[51] Int. Cl.[2] ..... H01T 13/20

[58] Field of Search ..... 313/141, 143, 141.1; 123/169 EL; 29/25.12

[56] References Cited

UNITED STATES PATENTS

| | | | |
|---|---|---|---|
| 2,327,220 | 8/1943 | Ruddies | 313/141.1 |
| 3,119,944 | 1/1964 | Lentz et al. | 313/141.1 UX |
| 3,256,457 | 6/1966 | Bretsch | 313/143 X |
| 3,356,882 | 12/1967 | Hallauer et al. | 313/141 |
| 3,407,326 | 10/1968 | Romine | 313/141 |
| 3,548,239 | 12/1970 | Eaton | 313/141 X |
| 3,673,452 | 6/1972 | Brennen | 313/141 |

*Primary Examiner*—R. V. Rolinec
*Assistant Examiner*—Darwin R. Hostetter
*Attorney, Agent, or Firm*—Talburtt & Baldwin

[57] ABSTRACT

Chromium plated corrosion oxidation resistant spark plug electrode.

17 Claims, 3 Drawing Figures

SPARK PLUG

BACKGROUND

In order to increase the life of spark plugs the center electrodes thereof have been provided with firing tips of corrosion and oxidation resistant metals, such as those of the platinum metal family, i.e., gold, osmium, iridium, ruthenium, palladium, rhodium and platinum, platinum and gold being preferred.

Since these metals are expensive, only the firing tip is composed of them, the tip being attached to the lower end of the center electrode, the balance of which consists of some less expensive metal such as nickel or the like.

The joining of the firing tip to the center electrode is typically accomplished by welding, such as resistance welding, brazing and the like. Other joining techniques, such as swaging or other mechanical locking, may also be used. Any mode which provides a sound bond and which is electrically conductive is satisfactory for forming the joint.

A problem which has arisen at these joints or interfaces is the oxidation and corrosion attack thereat which causes partial and sometimes complete separation of the tip from the rest of the electrode body. This in part is due to the corrosive action resulting from the combustion process. The result is a decrease in or loss of the conduction of electricity to the tip and a voltage drop which affects the function of the plug.

SUMMARY

It is a general object of this invention to provide spark plugs having improved long life.

It is a primary object of this invention to provide a different material for the protection of the joint formed between the firing tip and the lower end of the center electrode of a spark plug.

It is also an important object of the invention to provide a protective material which is inexpensive.

These objects and others are attained by the use of a protective layer of chromium at least over the joint area of the center electrode. The chromium may also extend completely over the entire firing tip. Chromium has been found to be surprisingly effective in protecting the joint from oxidation and corrosion attack.

DESCRIPTION OF THE PREFERRED EMBODIMENT

Figure 1:
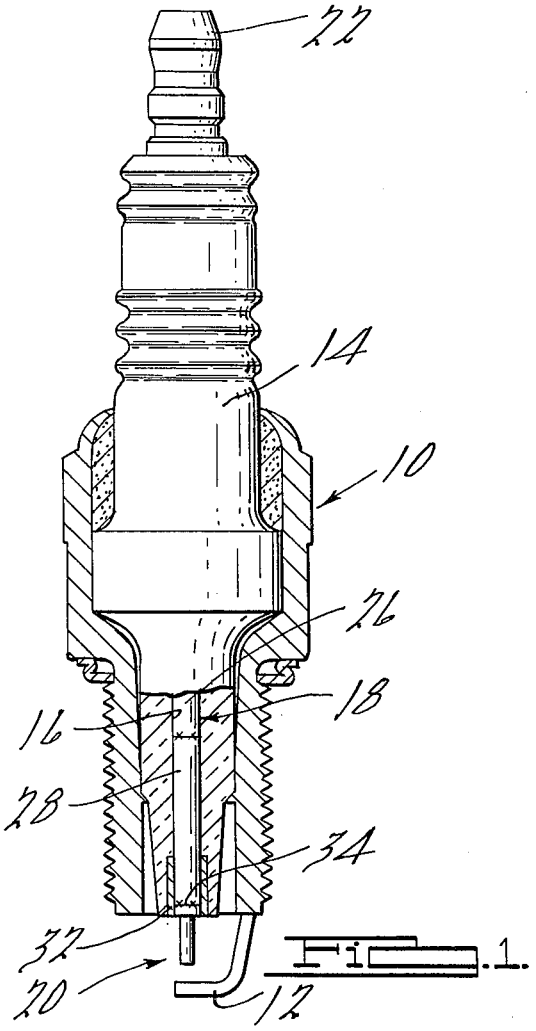
FIG. 1 is a spark plug assembly in partial vertical section.

Referring to the drawings, FIG. 1 in particular, 10 designates the customary threaded metal shell of a spark plug having at its lower end a ground electrode 12, which so far as the present invention is concerned may be of any suitable form and construction. The customary insulator 14 is mounted in the shell in any customary manner and has an axial bore 16 therethrough in which a center electrode 18 is mounted with its firing end or tip 20 exposed and suitably spaced with respect to the ground electrode 12 to provide a spark gap therebetween as is well understood in the art.

Figure 2:
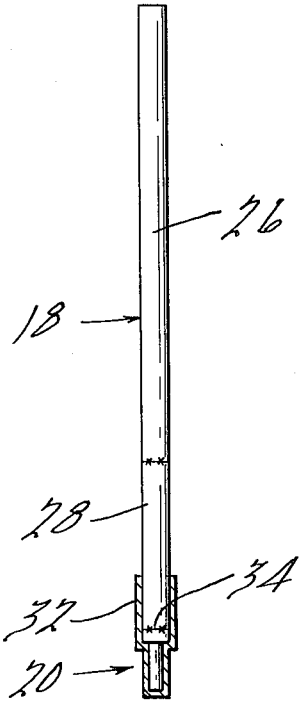
FIG. 2 is an elevation of one type of center electrode in common use in spark plugs.

The center electrode is electrically connected at its upper end to a terminal stud 22 as is customary. The electrode itself is relatively thin in diameter as shown in FIG. 2 and may comprise an upper portion 26 of one material such as copper coated steel, an intermediate portion 28 of another material such as a 95% nickel alloy or a nickel-base alloy and the lower portion or firing tip 20 such as platinum or platinum containing a small amount of tungsten, but substantially platinum. For example, it might be 96% platinum and 4% tungsten by weight and may also contain 0.2% thorium oxide, tungsten carbide or other grain growth inhibitors. Another example of a firing tip material is 60% gold, 40% palladium, by weight. The exact metal or composition used for the firing tip may vary. For long life the various members of the platinum metal family are preferred sometimes with small amounts of alloying elements therewith. However, platinum or platinum-tungsten is most preferred due to its high melting point, spark erosion resistance and corrosion and oxidation resistance. A 95% nickel or a nickel-base alloy is preferred for the remainder of the center electrode or at least that portion which is joined to the firing tip, particularly when platinum is used for the tip.

In accordance with the invention the corrosion resistant firing tip such as 20 which is usually joined to a dissimilar metal, constituting at least a portion of the center electrode, that is the portion to which the firing tip is joined such as portion 28, is protected by providing a covering layer 32 of chromium at least at the periphery of the joint or weld interface 34 substantially as shown in FIG. 1. The chromium layer may be conveniently formed at the joint by electroplating. Any standard chromium plating bath may be used. For example, a 250 g/liter chromic acid in water containing about 2.5 g/liter sulfate ion (sulfuric acid or sodium sulfate, typically) bath has been found satisfactory. At temperatures of 110° – 120°F. (43° – 50° C) and current densities of 1–2 amps/sq. inch, chromium layers of about 0.0003 inch have been formed at the joints of center electrodes in about fifteen minutes. The electrodes were of a nickel upper portion having a firing tip of 96% platinum — 4% tungsten and the chromium was plated over the entire firing tip and up to about one-half inch above the joint. Thicknesses of from 0.0002 to 0.0004 inches are satisfactory. The entire tip need not be covered with the chromium plate, but it is preferred. It is not necessary that the plate extend one-half inch above the joint. It is only necessary that the periphery of the weld interface or joint area itself be substantially covered and protected by the chromium layer. Typical center electrodes are 0.070 inch in diameter at the upper portion and 0.040 inch in diameter at the firing tip. The tip may be about three-sixteenths inch long. The over-all electrode length may vary.

When the chromium is to be plated over nickel, care should be taken to clean the nickel thoroughly or it tends to become passive. The standard cathodic alkaline electroclean bath (1 minute) followed by immersion in a 50% HCl bath (30 seconds) and a 3 volt live entry into the chromium bath works well with a nickel article.

Figure 3:
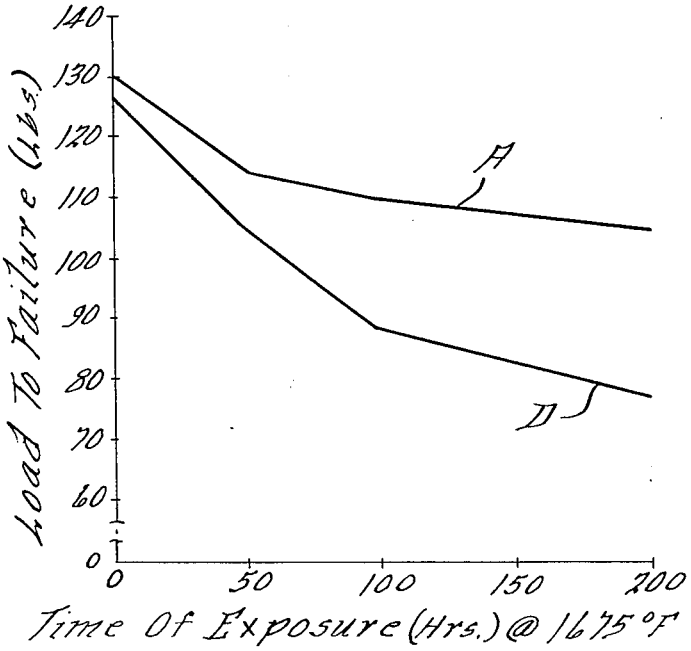
FIG. 3 is a graph showing tensile test results of various electrodes.

Referring to FIG. 3, the graph depicted therein shows the comparable average results of some tensile load and fracture tests of several types of spark plug center electrodes having platinum firing tips resistance butt upset welded to nickel upper portions. These electrodes were exposed to static and moving air conditions at an elevated temperature of 1,675° F (913°C) over the various times shown following which they were subjected to tensile pull tests as indicated on the graph. Failures for unplated anodes occurred in 100 hours at low loads at the weld joints. Failure of the chromium plated anodes did not occur until well after 100 hours indicative of the oxidation and corrosion resistance thereof. Microexamination of chromium plated anodes revealed no oxidation penetration in at least 45 to 100 hours of oxidation exposure. On the graph, A indicates electrodes in which the firing tips were protected by a layer of chromium about 0.0003 inches thick. Layers of from about 0.0002 to 0.0004 have been found to be satisfactory. Type D comprised electrodes with no protection at the resistance welded joint. As can be seen from the graph, type A is superior to type D because it is stronger and the joint is less prone to attack by oxidation.

The invention is not limited to any specific spark plug construction or any specific center electrode construction or materials. Rather, it is directed to the provision of a protective chromium layer covering at least the periphery of the joint or interface which exists between the center electrode and its firing tip and which may extend over the complete tip as shown in the alternative in FIG. 2.

What is claimed is:

1. A spark plug having a center electrode terminating in a firing tip which is joined thereto and a protective layer of chromium substantially covering at least the joint area between the electrode and firing tip for protecting the joint from weakening by oxidation, corrosion and the like.

2. The spark plug of claim 1 wherein the entire tip of the electrode is substantially covered with a layer of chromium also.

3. The spark plug of claim 1 wherein the firing tip consists essentially of one of the members of the platinum metals family.

4. The spark plug of claim 3 wherein at least the portion of the electrode immediately above the firing tip consists essentially of nickel.

5. The spark plug of claim 1 wherein the chromium layer is electroplated chromium.

6. The spark plug of claim 1 wherein the chromium layer is less than about 0.0004 inches thick.

7. The spark plug of claim 1 wherein the firing tip consists essentially of platinum.

8. The spark plug of claim 7 wherein at least the portion of the electrode joining the firing tip consists essentially of nickel.

9. The spark plug of claim 8 wherein the nickel and platinum portions of the electrode are joined by a resistance weld.

10. The spark plug of claim 1 wherein the layer of chromium extends above the joint area.

11. The spark plug of claim 10 wherein the layer extends less than about one-half inch above the joint area.

12. The spark plug of claim 10 wherein the layer of chromium is applied by electroplating.

13. The spark plug of claim 12 wherein the entire end of the electrode including both the joint area and the tip are substantially covered by the chromium.

14. A center electrode for a spark plug comprising:

an electrode body, a firing tip joined to the lower portion of the electrode body, and a protective layer of chromium substantially covering at least the joint area on the electrode.

15. The electrode of claim 14 wherein at least the lower end of the electrode body consists essentially of nickel, and the firing tip consists essentially of platinum.

16. The electrode of claim 14 wherein the chromium layer is less than about 0.0004 inches thick.

17. The electrode of claim 14 wherein the chromium is electroplated onto the electrode.

* * * * *